US010632776B2

(12) United States Patent
Fujimoto

(10) Patent No.: US 10,632,776 B2
(45) Date of Patent: Apr. 28, 2020

(54) PROCESSED MEDIUM MANUFACTURING METHOD, DATA GENERATION METHOD, COMPUTER-READABLE STORAGE MEDIUM, AND STRUCTURE MANUFACTURING METHOD

(71) Applicant: CASIO COMPUTER CO., LTD., Tokyo (JP)

(72) Inventor: Hitomi Fujimoto, Akishima (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 519 days.

(21) Appl. No.: 15/381,685

(22) Filed: Dec. 16, 2016

(65) Prior Publication Data

US 2017/0274584 A1 Sep. 28, 2017

(30) Foreign Application Priority Data

Mar. 22, 2016 (JP) ..... 2016-057229

(51) Int. Cl.
*B41M 3/00* (2006.01)
*B41M 7/00* (2006.01)
(Continued)

(52) U.S. Cl.
CPC ..... *B41M 3/00* (2013.01); *B41M 3/006* (2013.01); *B41M 3/06* (2013.01); *B41M 3/16* (2013.01); *B41M 7/0081* (2013.01)

(58) Field of Classification Search
CPC ..... B41M 3/00; B41M 7/0081; B41M 3/006; B41M 3/06; B41M 3/16
See application file for complete search history.

(56) References Cited

U.S. PATENT DOCUMENTS 8,870,327 B2 * 10/2014 Kanamura ..... B41J 3/407 347/15
9,492,956 B2 * 11/2016 Horiuchi ..... B41J 3/28
(Continued)

FOREIGN PATENT DOCUMENTS

JP H64-028658 A 1/1989
JP S64-28658 A 1/1989
(Continued)

OTHER PUBLICATIONS

Google translation of JP 2001-150812, published on Jun. 2001. (Year: 2001).*
(Continued)

*Primary Examiner* — Huan H Tran
(74) *Attorney, Agent, or Firm* — Scully Scott Murphy & Presser

(57) ABSTRACT

A structure manufacturing method manufactures a structure including an expansion layer M2 by expanding the expansion layer M2 that is included in a print medium M and expands by heating. An electromagnetic wave-heat conversion material is formed on a first surface of the print medium M in density corresponding to a shape of a structure C0 to be manufactured. Here, either the material is formed in lower density than density of the material in a first part of the expansion layer M2 to be expanded to a first height H1 and density of the material in a second part of the expansion layer M2 to be expanded to a second height H2 or the material is not formed, in a boundary region A0 which is the first surface in a boundary part between the first part and the second part. The print medium M is then irradiated with electromagnetic waves.

8 Claims, 7 Drawing Sheets

(51) Int. Cl.
*B41M 3/06* (2006.01)
*B41M 3/16* (2006.01)

(56) References Cited

U.S. PATENT DOCUMENTS

| | | | | |
|---|---|---|---|---|
| 9,522,490 | B2 * | 12/2016 | Horiuchi | B29C 44/0461 |
| 9,579,833 | B2 * | 2/2017 | Horiuchi | B29C 44/022 |
| 10,005,208 | B2 * | 6/2018 | Horiuchi | B29C 44/022 |
| 2012/0218338 | A1 * | 8/2012 | Kanamura | B41J 3/407 347/15 |
| 2013/0161874 | A1 * | 6/2013 | Horiuchi | B29C 44/022 264/415 |
| 2013/0168903 | A1 * | 7/2013 | Horiuchi | B29C 44/0461 264/413 |
| 2013/0229478 | A1 * | 9/2013 | Horiuchi | B41M 7/009 347/188 |
| 2014/0110887 | A1 * | 4/2014 | Horiuchi | B41J 3/28 264/413 |
| 2017/0274672 | A1 * | 9/2017 | Fukuda | B41J 2/2103 |

FOREIGN PATENT DOCUMENTS

| | | | |
|---|---|---|---|
| JP | H10-324010 | A | 12/1998 |
| JP | 2001-150812 | A | 6/2001 |
| JP | 2004-077841 | A | 3/2004 |
| JP | 2012-171317 | A | 9/2012 |
| JP | 2013-097211 | A | 5/2013 |
| JP | 5212504 | B2 | 6/2013 |

OTHER PUBLICATIONS

Google translation of JP 2013-132765, published on Jul. 2013 (Year: 2013).*

Notification of Reasons for Refusal dated Feb. 27, 2018 received in Japanese Patent Application No. 2016-057229 together with an English language translation.

* cited by examiner

PROCESSED MEDIUM MANUFACTURING METHOD, DATA GENERATION METHOD, COMPUTER-READABLE STORAGE MEDIUM, AND STRUCTURE MANUFACTURING METHOD

CROSS-REFERENCE TO RELATED APPLICATIONS

This application is based upon and claims the benefit of priority from the prior Japanese Patent Application No. 2016-057229, filed Mar. 22, 2016, the entire contents of which are incorporated herein by reference.

BACKGROUND OF THE INVENTION

1. Field of the Invention

The present invention relates to a processed medium manufacturing method, a data generation method, a computer-readable storage medium, and a structure manufacturing method.

2. Description of the Related Art

As one of the structure manufacturing techniques, a technique of printing, in black ink or toner which is a material (electromagnetic wave-heat conversion material) for converting light (electromagnetic waves) into heat, a desired pattern on a print medium including an expansion layer that expands by heating and then irradiating the print medium uniformly with light to heat and expand the expansion layer is known. This technique prints, in black ink or toner, the pattern in the region where the expansion layer is to be expanded, utilizing the property that heat is generated to heat the expansion layer in the region printed in black ink or toner whereas no heat is generated and thus the expansion layer is not heated in the other region. Japanese Patent Application Laid-Open No. 2012-171317 describes a three-dimensional printer using this technique.

Typically, there is a correlation between the formation density of the black ink or toner as the electromagnetic wave-heat conversion material on a surface of the print medium by area coverage modulation and the expansion height of the part where the electromagnetic wave-heat conversion material is formed in the expansion layer provided on one surface side of the print medium. This relationship, i.e. the relationship between the formation density of the electromagnetic wave-heat conversion material and the expansion height, is known from preliminary experiment, etc. for each type of print medium. In other words, if the expansion height to which the expansion layer is to be expanded is determined, the formation density of the electromagnetic wave-heat conversion material to realize the expansion height is uniquely determined. Hence, if the height of the structure to be manufactured by expanding the expansion layer of the print medium, i.e. the intended expansion height associated with each coordinate position on the surface of the print medium, is known, the density associated with each coordinate position on the surface of the print medium is uniquely determined based on the aforementioned known relationship. Based on the density distribution determined in this way, the electromagnetic wave-heat conversion material is printed on the surface of the print medium. Actually, however, the expansion height of the expansion layer of the print medium may be influenced by not only the formation density of the electromagnetic wave-heat conversion material at each coordinate position but also the formation density of the electromagnetic wave-heat conversion material in a region surrounding the coordinate position.

In view of such circumstances, the present invention has an object of providing a technique for manufacturing a structure of a desired shape by expanding an expansion layer of a print medium.

SUMMARY OF THE INVENTION

According to one aspect of the present invention, a processed medium manufacturing method includes: forming a material for converting electromagnetic wave energy into heat energy on a first surface of a print medium including an expansion layer that expands by heating, in density corresponding to a shape of a structure to be manufactured by expanding the expansion layer; and either forming the material in lower density than density of the material in a first part of the expansion layer to be expanded to a first height and density of the material in a second part of the expansion layer to be expanded to a second height or not forming the material, in a boundary region which is the first surface in a boundary part between the first part and the second part.

According to one aspect of the present invention, a data generation method for generating shading pattern data of density of a material for converting electromagnetic wave energy into heat energy includes: acquiring input shading pattern data for designating density corresponding to a shape of a structure to be manufactured by expanding an expansion layer that is included in a print medium and expands by heating; specifying a boundary region which is a first surface in a boundary part between a first part of the expansion layer to be expanded to a first height and a second part of the expansion layer to be expanded to a second height, based on the input shading pattern data; and converting data in the input shading pattern data corresponding to the specified boundary region into lower-density data representing either lower density than density corresponding to the first height and density corresponding to the second height or density 0, to generate output shading pattern data including the lower-density data.

According to one aspect of the present invention, computer-readable storage medium for controlling a data generation apparatus including a control unit causes the control unit to perform: a process of acquiring input shading pattern data for designating density corresponding to a shape of a structure to be manufactured by expanding an expansion layer that is included in a print medium and expands by heating, the density being density of a material to be formed on a first surface of the print medium for converting electromagnetic wave energy into heat energy; a process of specifying a boundary region which is the first surface in a boundary part between a first part of the expansion layer to be expanded to a first height and a second part of the expansion layer to be expanded to a second height, based on the input shading pattern data; and a process of converting data in the input shading pattern data corresponding to the specified boundary region into lower-density data representing either lower density than density corresponding to the first height and density corresponding to the second height or density 0, to generate output shading pattern data including the lower-density data.

According to one aspect of the present invention, a structure manufacturing method for manufacturing a structure by expanding an expansion layer that is included in a print medium and expands by heating includes: forming a material for converting electromagnetic wave energy into heat energy on a first surface of the print medium, in density corresponding to a shape of the structure; irradiating the print medium with electromagnetic waves; and either forming the material in lower density than density of the material in a first part of the expansion layer to be expanded to a first height and density of the material in a second part of the expansion layer to be expanded to a second height or not forming the material, in a boundary region which is the first surface in a boundary part between the first part and the second part.

According to the present invention, it is possible to provide a technique for manufacturing a structure of a desired shape by expanding an expansion layer of a print medium.

DETAILED DESCRIPTION OF THE INVENTION

Figure 1:
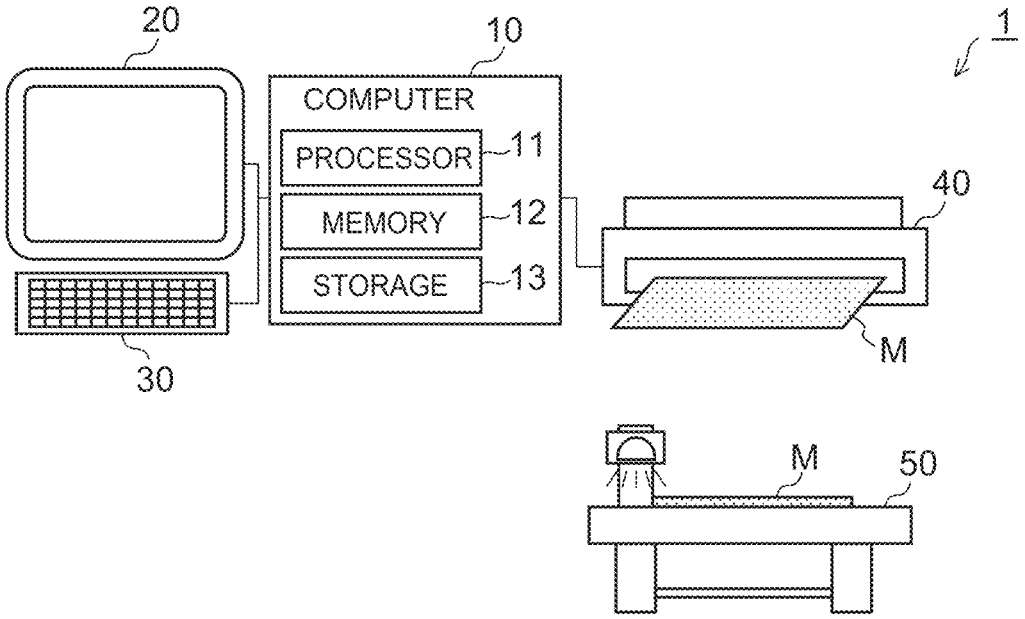
FIG. 1 is a diagram illustrating the configuration of a structure manufacturing system 1.
Figure 2:
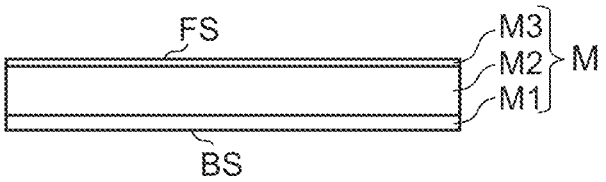
FIG. 2 is a diagram illustrating the configuration of a print medium M.
Figure 3:
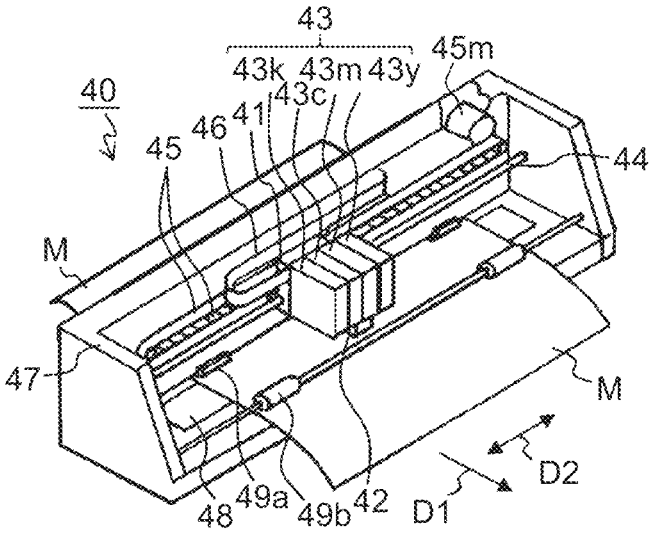
FIG. 3 is a diagram illustrating the configuration of a printer 40.
Figure 4:
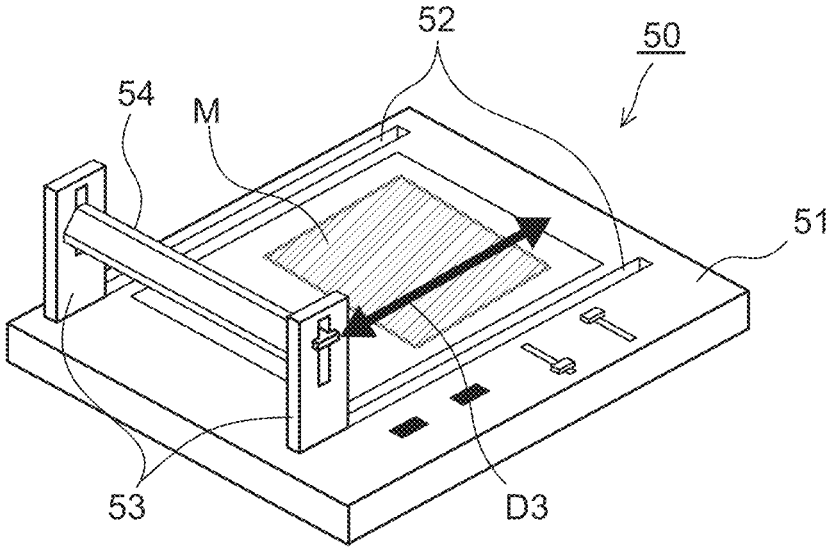
FIG. 4 is a diagram illustrating the configuration of a heater 50.

FIG. 1 is a diagram illustrating the configuration of a structure manufacturing system 1. FIG. 2 is a diagram illustrating the configuration of a print medium M. FIG. 3 is a diagram illustrating the configuration of a printer 40. FIG. 4 is a diagram illustrating the configuration of a heater 50.

The structure manufacturing system 1 includes a computer 10, a display device 20, an input device 30, the printer 40, and the heater 50, as illustrated in FIG. 1. The structure manufacturing system 1 forms a shading pattern which is a density image generated by the computer 10 on the print medium M including an expansion layer by the printer 40, and heats the print medium M with the shading pattern formed thereon by the heater 50 to manufacture a structure. The structure manufacturing system 1 further forms a color pattern which is a color image generated by the computer 10 on the print medium M by the printer 40, thus manufacturing a colored structure.

The print medium M is a thermal expansion sheet having a multilayer configuration in which an expansion layer M2 and an ink receiving layer M3 are stacked on a base material M1, as illustrated in FIG. 2. The ink receiving layer M3 is a layer for receiving ink ejected from the printer 40. The expansion layer M2 is a layer of thermoplastic resin containing countless microcapsules that expand by heating, and expands according to the amount of heat absorbed. The base material M1 is made of, for example, paper, cloth such as canvas, or a panel material such as plastic, although the material is not particularly limited. In the print medium M, the ink receiving layer M3 is thinner than the base material M1. Accordingly, the surface BS of the print medium M (the surface BS of the base material M1) is a surface farther from the expansion layer M2 from among the surfaces of the print medium M, and the surface FS of the print medium M (the surface FS of the ink receiving layer M3) is a surface closer to the expansion layer M2 from among the surfaces of the print medium M. A black shading pattern is formed on the surfaces FS and BS of the print medium M by the printer 40, as described later. The surface FS is also referred to as a second surface, given that the below-mentioned second pattern is formed on the surface FS. The surface BS is also referred to as a first surface, given that the below-mentioned first pattern is formed on the surface BS.

A shading pattern by area coverage modulation is formed on a surface in proximity to the expansion layer M2 (for example, the surface FS, BS) using a material for converting electromagnetic wave energy into heat energy (hereafter referred to as "electromagnetic wave-heat conversion material", which is ink of black K including carbon black as an example), as described later. Electromagnetic wave energy applied to the electromagnetic wave-heat conversion material is absorbed by the electromagnetic wave-heat conversion material, and converted into heat energy. In a part of the expansion layer M2 where the pattern is formed with the electromagnetic wave-heat conversion material, the electromagnetic wave-heat conversion is performed more efficiently than in a part of the expansion layer M2 where the pattern is not formed with the electromagnetic wave-heat conversion material. The heat energy generated in this way is transferred to mainly heat the part of the expansion layer M2 where the pattern is formed with the electromagnetic wave-heat conversion material, as a result of which the expansion layer M2 expands in the shape corresponding to the pattern formed with the electromagnetic wave-heat conversion material. Here, by forming the pattern to include shading by area coverage modulation using the electromagnetic wave-heat conversion material in proximity to the expansion layer M2, more heat energy is transferred in the part with higher formation density of the electromagnetic wave-heat conversion material than in the part with lower formation density of the electromagnetic wave-heat conversion material, thus expanding the expansion layer M2 to a greater height. In this specification, forming a pattern with a substance on the expansion layer M2 and forming a pattern with a substance on the surface FS or BS of the print medium M mean to form the pattern with the substance directly on or in proximity to the expansion layer M2. Moreover, in this specification, forming a pattern with a substance (material) on a surface is also referred to as forming the substance (material) on the surface.

The computer 10 is a computing unit including a processor 11, memory 12, and a storage 13, as illustrated in FIG. 1. The computer 10 generates image data through the execution of a program by the processor 11, and outputs print data corresponding to the image data to the printer 40. The display device 20 is, for example, a liquid crystal display, an organic electroluminescent (EL) display, or a cathode ray tube (CRT) display, and displays an image according to a signal from the computer 10. The input device 30 is, for example, a keyboard, a mouse, etc., and outputs a signal to the computer 10.

The printer 40 is an inkjet printer that prints the print medium M based on input print data. The printer 40 includes a carriage 41 capable of reciprocating in the direction (main scan direction D2) indicated by the two-headed arrow orthogonal to the medium conveyance direction (sub-scan direction D1), as illustrated in FIG. 3. A print head 42 for executing printing and ink cartridges 43 (43*k*, 43*c*, 43*m*, 43*y*) storing ink are attached to the carriage 41. The cartridges 43*k*, 43*c*, 43*m*, and 43*y* respectively store color inks of black K, cyan C, magenta M, and yellow Y. The ink of each color is ejected from a corresponding nozzle of the print head 42.

The ink of black K includes carbon black as the electromagnetic wave-heat conversion material in some cases, and does not include carbon black in other cases. In the case of forming a density image (gray scale image) on the surface of the expansion layer M2 using the ink of black K including carbon black, heat energy generated by irradiating the image with electromagnetic waves is transferred to expand the expansion layer M2. In the case of forming the same density image with the ink of black K not including carbon black or a color mixture of color inks of cyan C, magenta M, and yellow Y, on the other hand, no heat energy is generated when irradiating the density image with electromagnetic waves, so that the part of the expansion layer M2 where the density image is formed does not expand.

The carriage 41 is slidably supported by a guide rail 44, and sandwiched by a drive belt 45. When the drive belt 45 is driven by rotating a motor 45*m*, the carriage 41 moves in the main scan direction D2 together with the print head 42 and the ink cartridges 43. A platen 48 extending in the main scan direction D2 is placed in the lower part of a frame 47 at the position facing the print head 42. Moreover, a feed roller pair 49*a* (the lower roller is not illustrated) and a discharge roller pair 49*b* (the lower roller is not illustrated) are arranged to convey the print medium M supported on the platen 48 in the sub-scan direction D1.

A control unit of the printer 40 connected to the print head 42 via a flexible communication cable 46 controls the motor 45*m*, the print head 42, the feed roller pair 49*a*, and the discharge roller pair 49*b*, based on print data and print control data from the computer 10. Thus, at least a shading pattern is formed on the print medium M, and a color pattern is further formed on the print medium M if necessary. In other words, at least the aforementioned density image is printed, and the color image is further printed if necessary. In the case where there is no need to expand the expansion layer M2, only the color pattern may be formed on the expansion layer M2 without forming the shading pattern.

The shading pattern is an image formed on the surface of the expansion layer M2 so that, when the formed image is irradiated with electromagnetic waves, the expansion layer M2 is expanded to a desired height by heating to obtain a desired structure. Thus, the term "shading pattern" in this specification means an image formed on the surface of the expansion layer M2 using the aforementioned electromagnetic wave-heat conversion material, and does not mean an image including shading formed using a material not containing the electromagnetic wave-heat conversion material. At least a part of the color image may be formed using the electromagnetic wave-heat conversion material. However, when electromagnetic waves are applied after the formation of such a color image, the expansion layer M2 expands over the desired height intended by the formation of the shading pattern alone, as described in detail later. It is therefore desirable to, after the formation of the color image, avoid irradiating the surface of the expansion layer M2 where the color image is formed with electromagnetic waves.

The heater 50 is a device that heats the print medium M by irradiating it with electromagnetic waves. The heater 50 includes a placement table 51 having guide grooves 52, a support 53 supporting a light source unit 54, and the light source unit 54 including a light source, as illustrated in FIG. 4. The print medium M with a shading pattern formed thereon is placed on the placement table 51. The support 53 is configured to slide along the guide grooves 52. The light source in the light source unit 54 emits electromagnetic waves.

In the heater 50, the light source unit 54 moves in the direction D3 together with the support 53 while emitting electromagnetic waves, to irradiate the print medium M uniformly with the electromagnetic waves. In the region in which the shading pattern is printed, the electromagnetic waves are efficiently absorbed and converted into heat energy, as mentioned earlier. Thus, the region corresponding to the shading pattern is heated and expands to manufacture the structure corresponding to the shading pattern.

In the case where the shading pattern is printed in the ink of black K including carbon black, the electromagnetic waves desirably include infrared wavelengths. The wavelength range of the electromagnetic waves is, however, not particularly limited as long as heat is more efficiently absorbed for heating in the region printed in the ink used for shading pattern formation than in the region not printed in the ink. The ink used for shading pattern formation includes at least a material for absorbing electromagnetic waves and converting them into heat energy.

Figure 5:
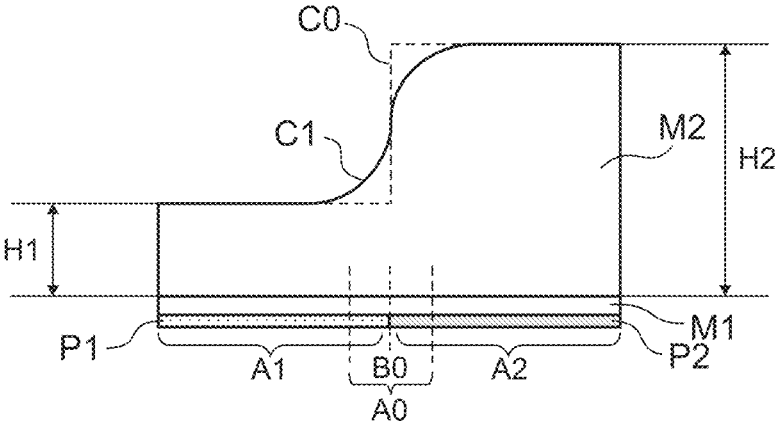
FIG. 5 is a diagram illustrating a structure manufactured by a conventional structure manufacturing system.

FIG. 5 is a diagram illustrating a structure manufactured by a conventional structure manufacturing system. In the conventional structure manufacturing system, when shading patterns (shading patterns P1 and P2) corresponding to different heights and each having uniform density are formed in two adjacent regions (a first region A1 and a second region A2) of the surface BS of the print medium M (the surface of the base material M1), the three-dimensional shape of a structure C1 manufactured by applying electromagnetic waves differs from the three-dimensional shape of a structure C0 designated by the shading patterns formed on the surface BS, i.e. the height at each coordinate position of the structure C0 determined based on the aforementioned known relationship from the shading patterns formed on the surface BS, as illustrated in FIG. 5. In detail, in a region (hereafter referred to as "boundary region") A0 that includes a boundary line B0 as the boundary of the two regions and extends along the boundary line B0, the expansion layer M2 expands higher than the designated height H1 in the region included in the first region A1 due to the influence of the second region A2, and the expansion layer M2 expands lower than the designated height H2 in the region included in the second region A2 due to the influence of the first region A1. Such a phenomenon not only results in the manufacture of a structure whose shape is different from the designated three-dimensional shape, but also makes it difficult to manufacture a structure having a sharp three-dimensional shape. Hereafter, the part of the expansion layer M2 above the boundary region A0 is referred to as "boundary part", to distinguish it from the boundary region.

Figure 6:
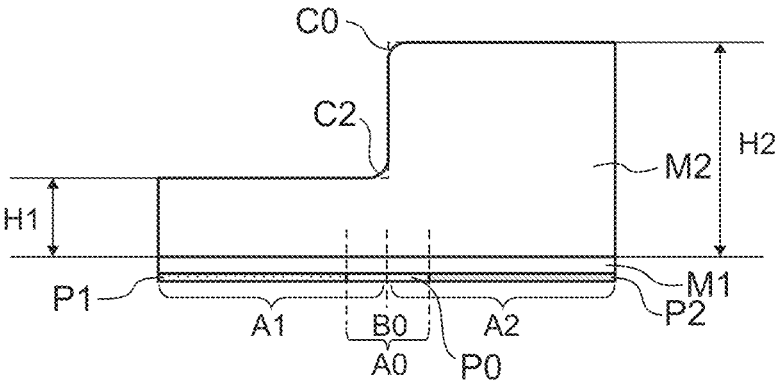
FIG. 6 is a diagram illustrating a structure manufactured by the structure manufacturing system 1.

In anticipation of such a phenomenon, in the structure manufacturing system 1, a shading pattern P0 of lower density (lighter density) than the density corresponding to each of the heights H1 and H2 is formed in the boundary region A0, as illustrated in FIG. 6. The lower density mentioned here is, for example, the density corresponding to the height 0. The density corresponding to the height 0 is about 0% to 10% (of the highest density), as an example. Forming the electromagnetic wave-heat conversion material on the surface BS of the base material M1 within this density range is unlikely to affect the expansion of the expansion layer. This density range is, however, merely an example of the lower density, and does not limit the present invention. The boundary region A0 is a region including the boundary line B0 of the first region A1 and second region A2. The boundary region A0 is desirably a region centering on the boundary line B0 and extending to both sides by the same width. Instead of forming the pattern P0 of lower density in the boundary region A0, the formation of the pattern itself in the boundary region A0 may be omitted.

As a result, when applying electromagnetic waves, the expansion of the expansion layer M2 is suppressed above the first region A1 side region of the boundary region A0, whereas the expansion layer M2 is influenced by the second region A2 above the second region A2 side region of the boundary region A0. Thus, as illustrated in FIG. 6, the height of the part above the first region A1 side region of the boundary region A0 with respect to the boundary line B0 is approximately equal to the height H1 of the part above the first region A1, and the height of the part above the second region A2 side region of the boundary region A0 with respect to the boundary line B0 is approximately equal to the height H2 of the part above the second region A2. In other words, the expansion layer M2 can be expanded to the intended height H1 in substantially the whole part above the first region A1 with the intended expansion height H1, and the expansion layer M2 can be expanded to the intended height H2 in substantially the whole part above the second region A2 with the intended expansion height H2. As a result, the angle of the level difference formed by the region of the height H1 and the region of the height H2, i.e. the angle between the surface FS of the print medium M before the expansion and the slope between the region of the height H1 and the region of the height H2, is approximately 90 degrees. With the aforementioned method, it is possible to manufacture a structure C2 having a three-dimensional shape analogous to the three-dimensional shape of the structure C0 designated by the shading patterns P1 and P2, i.e. the height at each coordinate position of the structure C0 determined from the shading patterns P1 and P2 based on the aforementioned known relationship. The structure C2 manufactured in this way has a sharp three-dimensional shape with the shape of the boundary region A0, i.e. the level difference portion, being sharp, as compared with the structure C1.

The following describes the shading pattern to be printed for each three-dimensional shape of the structure C0 to be manufactured.

Figure 7A:
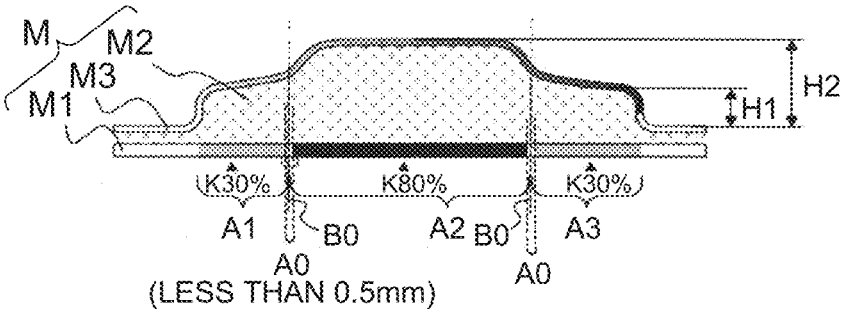
FIGS. 7A-C are diagrams for describing the relationship between the boundary region width and the three-dimensional shape.
Figure 7B:
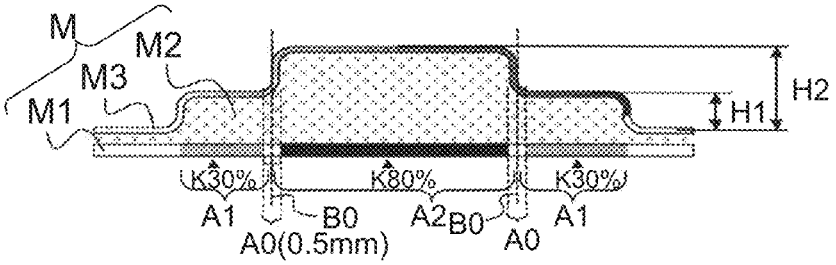
Figure 7C:
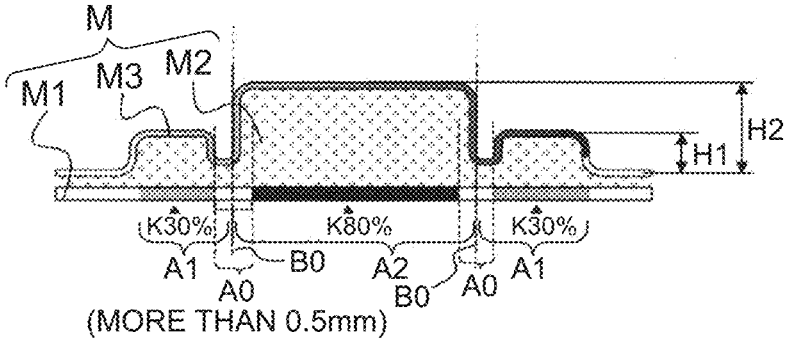

FIGS. 7A-C are diagrams for describing that the desired structure C0 can be manufactured by changing the width of the boundary region A0 depending on the three-dimensional shape of the structure C0 to be manufactured. In FIGS. 7A to 7C, the shading of the ink receiving layer M3 indicates the shading of the color pattern formed on the surface FS of the print medium M, and the shading of the base material M1 indicates the shading of the shading pattern formed on the surface BS of the print medium M. Thus, each drawing illustrates the expansion layer M2 that has expanded to the height corresponding to the density of the base material M1 and not to the height corresponding to the density of the ink receiving layer M3.

As illustrated in FIG. 7B, when the width of the boundary region A0 is adjusted to be within a predetermined range, it is possible to manufacture the desired structure C0 in which the height of the part above the first region side region of the boundary region A0 with respect to the boundary line B0 is equal to the height H1 of the part above the first region A1. In other words, by setting the width of the boundary region A0 in the direction across the boundary line B0 to a predetermined size, the angular part of the cross-sectional shape of the desired structure C0 to be manufactured along the height direction in the boundary region A0 can be made closer to substantially a right angle, as compared with the case of not forming the material in lower density or the case of forming the material in the boundary region A0. Although FIGS. 7A-C illustrate an example where the predetermined range is about 0.5 mm, the predetermined range may vary depending on the type of the print medium M, the surface on which the pattern is formed (e.g. whether the pattern is formed on the surface BS or the surface FS), etc. The predetermined range may be set beforehand by, for example, preliminary experiment for each type of print medium.

As illustrated in FIG. 7A, when the width of the boundary region A0 is less than the predetermined range, the angular part (the A0 side surface of the expansion portion) of the cross-sectional shape of the structure C0 to be manufactured along the height direction in the boundary region A0 is a little close to a right angle, as compared with the case where the boundary region A0 is not provided. In other words, by setting the width of the boundary region A0 in the direction across the boundary line B0 to be smaller than the predetermined size, the angular part of the cross-sectional shape of the desired structure C0 to be manufactured along the height direction in the boundary region A0 can be made closer to a right angle, as compared with the case of not forming the material in lighter density or the case of forming the material in the boundary region A0. Here, since the expansion suppression effect on the expansion layer M2 in the boundary region A0 is weaker, the height of the part above the first region side region of the boundary region A0 with respect to the boundary line B0 is not as low as the height H1 of the part above the first region A1, so that another desired structure can be manufactured.

As illustrated in FIG. 7C, when the width of the boundary region A0 is more than the predetermined range, another desired structure in which the height of the part above the first region side region of the boundary region A0 with respect to the boundary line B0 is lower than the height H1 of the part above the first region A1 can be manufactured, as the expansion suppression effect on the expansion layer M2 in the boundary region A0 is stronger. In other words, by setting the width of the boundary region A0 in the direction across the boundary line B0 to be greater than the predetermined size, a structure in which, between a first part and a second part, a part lower than the first and second parts is provided can be manufactured. Here, the first part is the part of the expansion layer M2 to be expanded to the first height H1, and the second part is the part of the expansion layer M2 to be expanded to the second height H2. In this example, the first part is the part of the expansion layer M2 above the first region A1 except the part (first boundary part) above the region overlapping the boundary region A0, and the second part is the part of the expansion layer M2 above the second region A2 except the part (second boundary part) above the region overlapping the boundary region A0.

Suppose each of the structures illustrated in FIGS. 7A to 7C is a desired structure. Then, a step of forming a shading pattern to form such a desired structure can be summarized as follows.

The step of forming the shading pattern is a step of either forming the electromagnetic wave-heat conversion material in lower density than the density of the material in the first part of the expansion layer M2 to be expanded to the first height H1 and the density of the material in the second part of the expansion layer M2 to be expanded to the second height H2 or not forming the material, in the boundary region A0 which is the first surface BS in the boundary part between the first part and the second part.

Figure 8A:
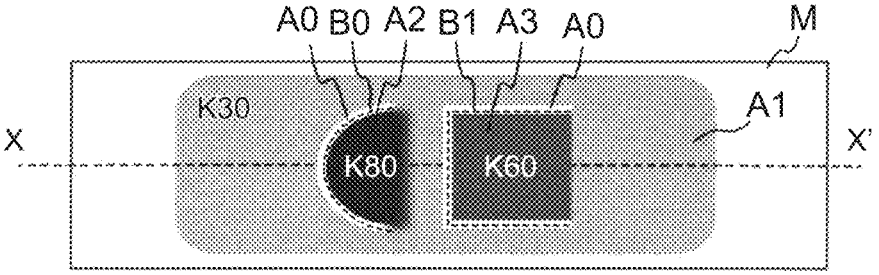
FIGS. 8A-B are diagrams for describing the difference between the case where a lower-density pattern is formed in the boundary region and the case where a lower-density pattern is not formed in the boundary region.
Figure 8B:
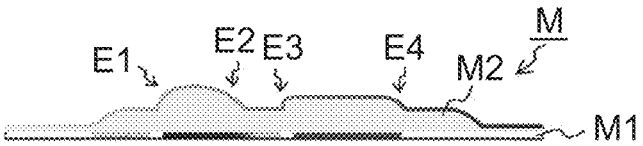

FIGS. 8A and 8*b* illustrate the difference between the case of forming a pattern of lower density and the case of not forming the pattern in the boundary region, when a pattern of higher density is formed within a region in which a pattern of uniform density has been formed. As illustrated in FIG. 8A, suppose a pattern of density 0% is formed in a part of a region between a region A1 in which a pattern of density 30% (K30) is formed and a region of higher density (a region A2 of density 80% (K80), a region A3 of density 60% (K60)) surrounded by the region A1. In such a case, a structure manufactured by irradiating the print medium M with electromagnetic waves has a sharp edge E1 or E3 near the boundary region A0 in which the pattern of density 0% is formed but has an edge E2 or E4 that gently changes in height in the region in which the pattern of density 0% is not formed, as illustrated in FIG. 8B which is a sectional view taken along plane X-X' in FIG. 8A. Although not illustrated, for example by increasing the width of the boundary region in which the pattern of density 0% is formed, a depression may be formed in the boundary region as illustrated in FIG. 7C. In FIG. 8A, the region A0 is a belt-like boundary region along at least a part of the outline of the region A2 or A3, and B0 and B1 are each a boundary line formed along the outline in the boundary region.

Figure 9:
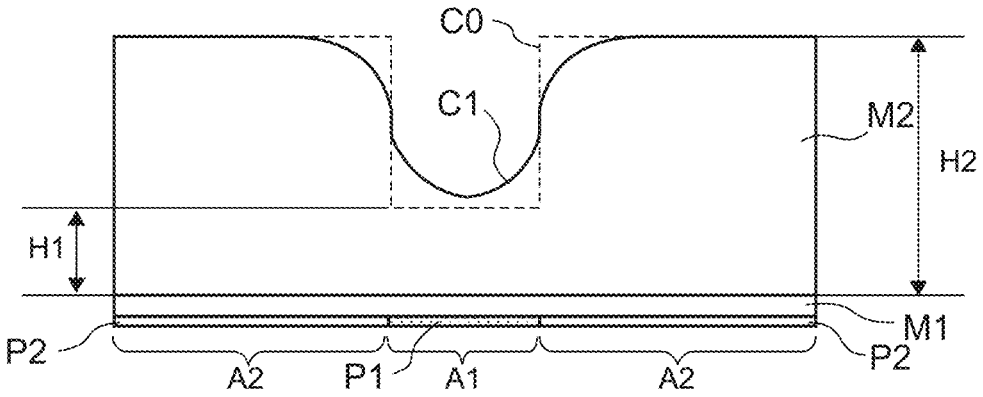
FIG. 9 is a diagram illustrating another example of the structure manufactured by the conventional structure manufacturing system.
Figure 10:
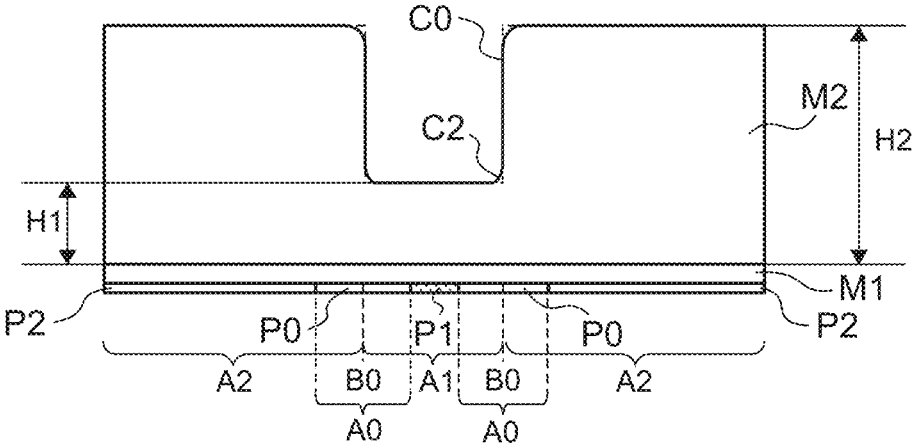
FIG. 10 is a diagram illustrating another example of the structure manufactured by the structure manufacturing system 1.

FIGS. 9 and 10 are diagrams for describing, when manufacturing the structure C0, how the structure changes depending on the shading pattern formed on the surface BS of the print medium M. The structure C0 is a structure having the height H1 in the first region A1, and the height H2 higher than the first region in the second region A2 on both sides of the first region A1. FIG. 9 illustrates the structure C1 actually manufactured in the case of forming the electromagnetic wave-heat conversion material in each of the regions A1 and A2 in the density determined based on the height of the structure C0 to be realized in the region and the aforementioned known relationship. Thus, simply forming the shading pattern based on the known relationship causes the structure C1 different in shape from the intended structure C0 to be manufactured. In detail, when the width of the first region A1, i.e. the distance between the two second regions A2, is less than a predetermined size, the whole part of the structure C1 corresponding to the first region A1 will end up expanding higher than the designated height.

In anticipation of such a phenomenon, in the structure manufacturing system 1, the shading pattern P0 of lower density than the density corresponding to each of the heights H1 and H2 is formed in the boundary region A0 including the boundary line B0 between the first region A1 and each of the second regions A2, as illustrated in FIG. 10. Meanwhile, the pattern P1 is left in the remaining part of the first region A1 between the two boundary regions A0. In detail, in the sectional view in FIG. 10, the density of the shading pattern is "density corresponding to height H2", "lower density", "density corresponding to height H1", "lower density", and "density corresponding to height H2" in this order from left. Instead of forming the pattern P0 of lower density, the formation of the pattern itself may be omitted. This suppresses the expansion of the expansion layer M2 in the boundary region A0 and the first region A1 as a whole when irradiated with electromagnetic waves, so that the height of the part above the first region A1 side region of the boundary region A0 with respect to the boundary line B0 and part above the first region A1 is approximately equal to the height H1 designated by the shading pattern P1, as illustrated in FIG. 10. As a result, the structure C2 whose three-dimensional shape is more analogous to the three-dimensional shape of the structure C0 designated by the shading patterns P1 and P2 can be manufactured. The structure C2 has a sharper three-dimensional shape than the structure C1.

Figure 11:
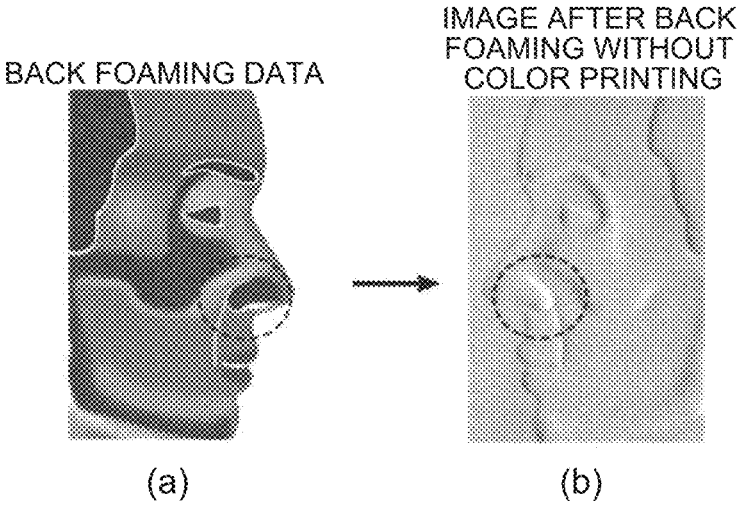
FIG. 11 is a diagram illustrating an example of manufacturing a structure representing a person's profile.

Through the use of the technique of reducing the density of the boundary region as described above, the shape expression by the structure manufactured using the print medium M including the expansion layer M2 can be improved significantly. This enables more natural expression of, for example, the wrinkle (nasolabial fold) on the side of the human nose illustrated in FIG. 11, which has been hard to be expressed conventionally. FIG. 11(*a*) illustrates a shading pattern formed on the print medium M, and FIG. 11(*b*) illustrates the three-dimensional shape of the structure manufactured using the shading pattern illustrated in FIG. 11(*a*).

Figure 12:
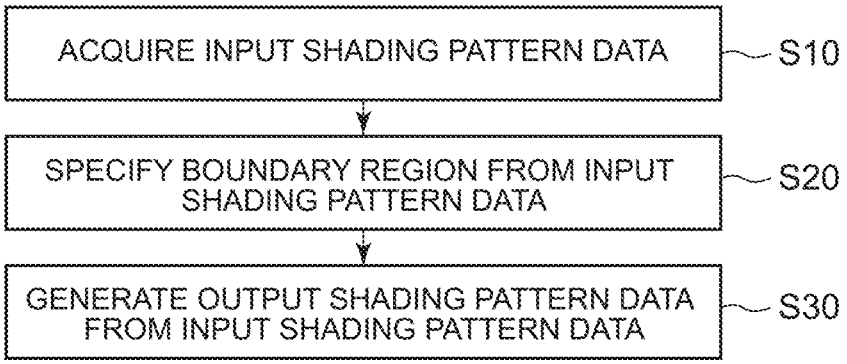
FIG. 12 is a flowchart illustrating a shading pattern data generation process.

FIG. 12 is a flowchart of a shading pattern data generation process. The following describes a method of generating shading pattern data representing the shading pattern corresponding to the three-dimensional shape of a structure to be manufactured by expanding the expansion layer M2 in detail, with reference to FIG. 12.

The shading pattern data generation process in FIG. 12 is, for example, performed by the computer 10 executing a shading pattern data generation program. First, the computer 10 acquires input shading pattern data (step S10). In step S10, for example, the computer 10 may acquire the input shading pattern data by generating the input shading pattern data from information input by the user using the input device 30, or acquire the input shading pattern data from an external device (not illustrated).

The input shading pattern data represents the shading pattern corresponding to the shape of the structure to be manufactured using the print medium M including the expansion layer M2. Accordingly, the shape of the structure to be manufactured using the print medium M is specified by the pattern (hereafter referred to as "input shading pattern") represented by the input shading pattern data.

Having acquired the input shading pattern data, the computer 10 specifies a boundary region from the acquired input shading pattern data (step S20). The boundary region is a region within a predetermined range from the boundary of two regions in which patterns that differ in density and each have uniform density are to be formed in the region in which the input shading pattern is to be formed, and includes the boundary of the first region A1 and second region A2 and extends to both sides of the boundary by the same width (i.e. centers on the boundary and extends to both sides by the same size). The predetermined range is set beforehand for each print medium M or for each combination of the print medium M and the surface on which the pattern is formed. For example, the predetermined range is the range of 0.5 mm in width centering on the boundary. In other words, the computer 10 specifies, from the input shading pattern data, the region within the predetermined range from the boundary between the region (first region) in which the part of the structure having the first height is to be manufactured and the region (second region) in which the part of the structure having the second height higher than the first height is to be manufactured.

After specifying the boundary region, the computer 10 generates output shading pattern data from the input shading pattern data (step S30). Here, the computer 10 converts the data of the part corresponding to the boundary region included in the input shading pattern data into lower-density data representing lower density than the density corresponding to the first height, to generate the output shading pattern data including the lower-density data. The lower-density data may be density 0 indicating that the electromagnetic wave-heat conversion material is not formed. After generating the output shading pattern data, the computer 10 stores the generated data in the storage 13, and ends the shading pattern data generation process.

With the shading pattern data generation process in FIG. 12, it is possible to generate shading pattern data in which the density of the boundary region influenced by its adjacent region is adjusted. The use of the generated shading pattern data can reduce the difference between the shape of the structure to be manufactured and the shape of the actually manufactured structure.

The following describes a method of manufacturing a structure of a desired shape using the print medium M based on the shading pattern data generated in the shading pattern data generation process in FIG. 12, by way of first to third embodiments. In an example described in each embodiment, a shading pattern (hereafter referred to as "first pattern") corresponding to a relatively large structural part of the structure to be manufactured is formed on the surface BS, a shading pattern (hereafter referred to as "second pattern") corresponding to a relatively small structural part of the structure to be manufactured is formed on the surface FS, and a color pattern is formed on the surface FS.

First Embodiment

Figure 13:
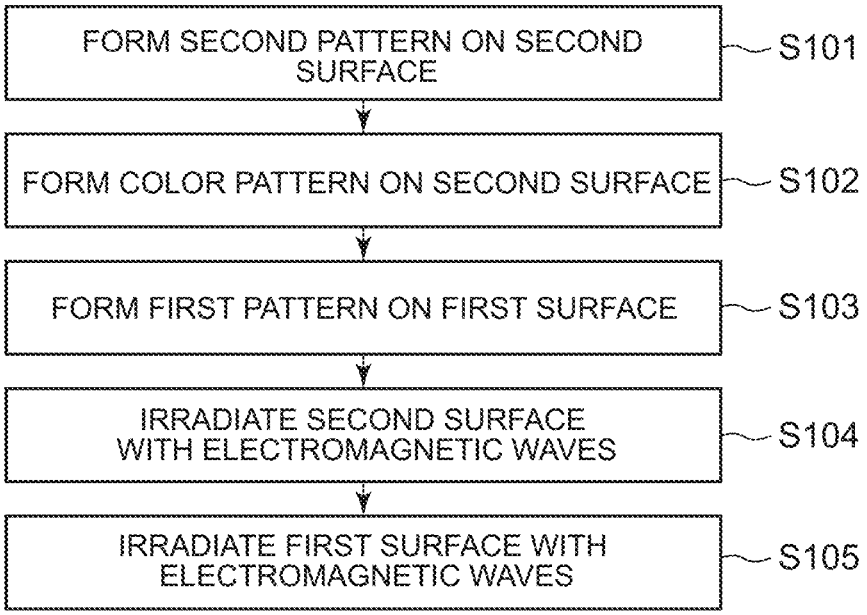
FIG. 13 is a flowchart of a structure manufacturing process according to a first embodiment.

FIG. 13 is a flowchart of a structure manufacturing process according to this embodiment. In this embodiment, the ink cartridge 43*k* in the printer 40 stores the ink of black K including carbon black. The ink of black K including carbon black is a material for absorbing electromagnetic waves and converting them into heat energy.

The structure manufacturing system 1 first forms a second pattern GP2 on the second surface (surface FS) (step S101). Here, the user sets the print medium M on the printer 40 so that the surface FS faces the print head 42, and inputs an instruction to form the second pattern GP2 to the computer 10. The computer 10 responsively generates the print data and print control data corresponding to the shading pattern data representing the second pattern GP2, and outputs the generated data to the printer 40. The printer 40 forms the second pattern GP2 on the surface FS of the print medium M in the ink of black K, based on the print data and print control data. The printer 40 controls the print density by, for example, area coverage modulation.

The structure manufacturing system 1 further forms a color pattern on the second surface (surface FS) (step S102). Here, the user inputs an instruction to form the color pattern to the computer 10. The computer 10 responsively generates the print data and print control data corresponding to the color pattern data representing the color pattern, and outputs the generated data to the printer 40. The printer 40 forms the color pattern on the surface FS of the print medium M in the color inks of cyan C, magenta M, and yellow Y, based on the print data and print control data. Black included in the color pattern is made by a color mixture of cyan C, magenta M, and yellow Y. The color inks of cyan C, magenta M, and yellow Y include no material for absorbing electromagnetic waves and converting them into heat energy, such as carbon black. Accordingly, even when the ink forming black made from the color mixture of these inks is irradiated with electromagnetic waves, the ink does not absorb the electromagnetic waves and convert them into heat energy. The pattern formations in steps S101 and S102 may be performed at the same time.

After forming the pattern on the second surface, the structure manufacturing system 1 forms a first pattern GP1 on the first surface (surface BS) (step S103). Here, the user sets the print medium M on the printer 40 so that the surface BS faces the print head 42, and inputs an instruction to form the first pattern GP1 to the computer 10. The computer 10 responsively generates the print data and print control data corresponding to the shading pattern data representing the first pattern GP1, and outputs the generated data to the printer 40. The printer 40 forms the first pattern GP1 on the surface BS of the print medium M in the ink of black K, based on the print data and print control data.

Figure 14:
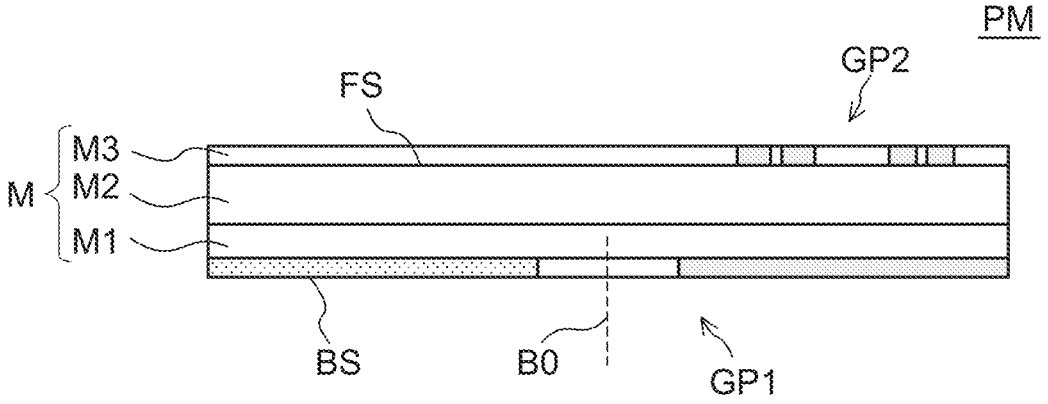
FIG. 14 is a diagram illustrating a processed medium manufactured in the structure manufacturing process illustrated in FIG. 13.

The first pattern GP1 is thus formed on the first surface. For example, a processed medium PM as illustrated in FIG. 14 is obtained in this way. Since such a shading pattern in which the density of the region that expands excessively due to the influence of its adjacent region is adjusted beforehand in view of the influence of the adjacent region is formed on the processed medium PM, simply applying electromagnetic waves under predetermined conditions enables a structure of a desired shape to be manufactured.

After this, the structure manufacturing system 1 irradiates the second surface (surface FS) with electromagnetic waves (step S104). Here, the user places the print medium M (processed medium PM) on which the pattern is formed, on the placement table 51 of the heater 50 in a state where the surface FS faces upward. The heater 50 then irradiates the surface FS of the print medium M uniformly with electromagnetic waves such as infrared. Hence, the ink of black K including carbon black forming the second pattern GP2 is irradiated with electromagnetic waves, to generate heat. As a result, the region of the expansion layer M2 where the second pattern GP2 is formed is heated to expand.

Figure 15:
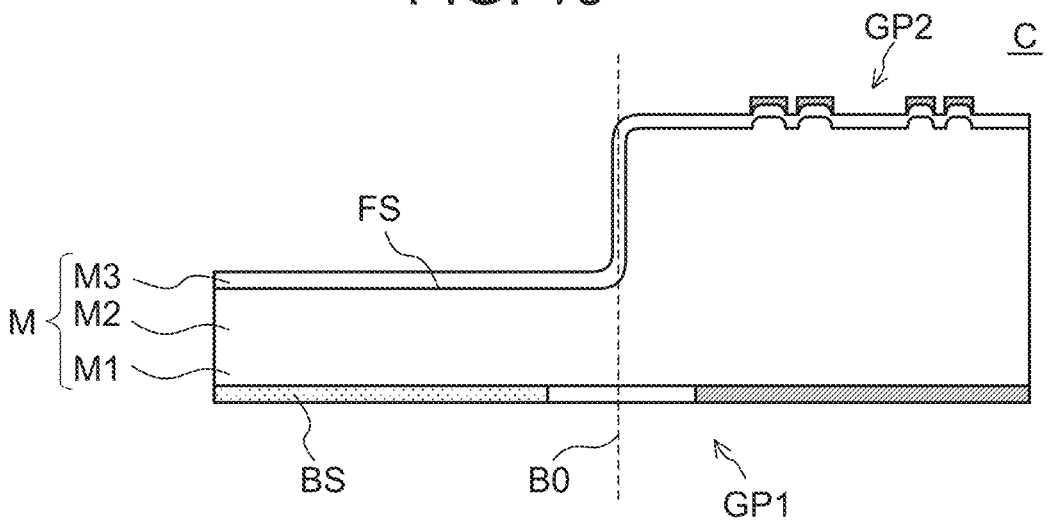
FIG. 15 is a diagram illustrating a structure manufactured in the structure manufacturing process illustrated in FIG. 13.

Lastly, the structure manufacturing system 1 irradiates the first surface (surface BS) with electromagnetic waves (step S105), and ends the structure formation process in FIG. 13. Here, the user places the print medium M (processed medium PM) on which the pattern is formed, on the placement table 51 of the heater 50 in a state where the surface BS faces upward. The heater 50 then irradiates the surface BS of the print medium M uniformly with electromagnetic waves such as infrared. Hence, the ink of black K including carbon black forming the first pattern GP1 is irradiated with electromagnetic waves, to generate heat. As a result, the region of the expansion layer M2 where the first pattern GP1 is formed is heated through the base material M1 to expand. FIG. 15 illustrates a structure C manufactured in the structure manufacturing process in FIG. 13.

According to this embodiment, the structure is manufactured using the shading pattern in which the density of the region influenced by its adjacent region is adjusted is manufactured, so that the difference between the shape of the structure to be manufactured and the shape of the actually manufactured structure can be reduced. Therefore, the structure of the desired shape can be manufactured using the print medium M.

Second Embodiment

Figure 16:
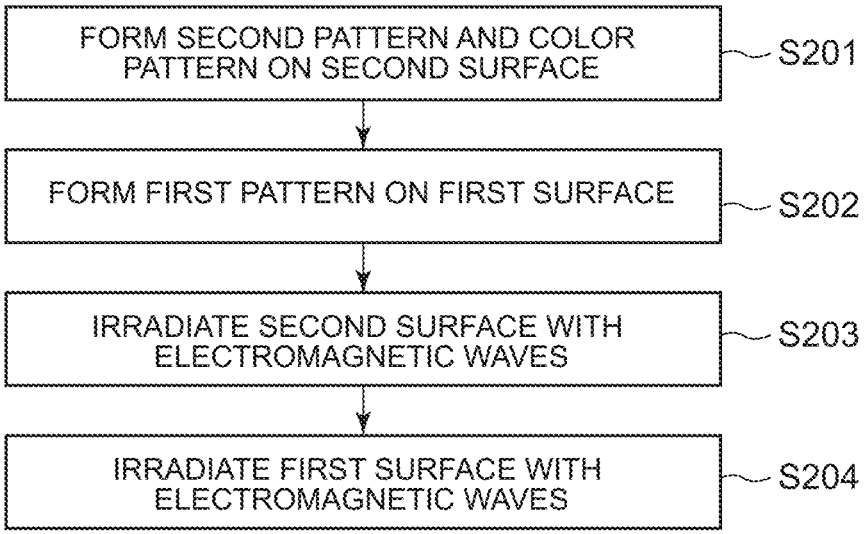
FIG. 16 is a flowchart of a structure manufacturing process according to a second embodiment.

FIG. 16 is a flowchart of a structure forming process according to this embodiment. The structure manufacturing system 1 is used in this embodiment, too. This structure manufacturing system 1 includes, instead of the printer 40, a printer having not only the ink cartridge 43*k* storing the ink of black K including carbon black but also an ink cartridge 43*k'* storing ink of black K' not including carbon black.

The structure manufacturing system 1 first forms the second pattern GP2 and the color pattern on the second surface (surface FS) (step S201). Here, the user sets the print medium M on the printer 40 so that the surface FS faces the print head 42, and inputs an instruction to form the second pattern GP2 and the color pattern to the computer 10. The computer 10 responsively generates the print data and print control data corresponding to the shading pattern data representing the second pattern GP2 and the color pattern data, and outputs the generated data to the printer 40. The printer 40 forms the second pattern GP2 on the surface FS of the print medium M in the ink of black K and also forms the color pattern on the surface FS in the inks of cyan C, magenta M, yellow Y, and black K', based on the print data and print control data.

After forming the patterns on the second surface, the structure manufacturing system 1 forms the first pattern GP1 on the first surface (surface BS) (step S202). Step S202 is the same as step S103 in FIG. 13. As a result, the processed medium PM as illustrated in FIG. 14 as an example is obtained. FIG. 14 illustrates only the second pattern GP2 and not the color pattern from among the patterns formed on the surface FS of the print medium M, for simplicity's sake.

The structure manufacturing system 1 then irradiates the second surface (surface FS) with electromagnetic waves (step S203), irradiates the first surface (surface BS) with electromagnetic waves (step S204), and ends the structure formation process in FIG. 16. Steps S203 and S204 are the same as steps S104 and S105 in FIG. 13.

According to this structure, too, the difference between the shape of the structure to be manufactured and the shape of the actually manufactured structure can be reduced. Therefore, the structure of the desired shape can be manufactured using the print medium M. Moreover, since black in the color pattern is represented by the ink of black K' not including carbon black in this embodiment, good coloration can be achieved while saving the ink consumption as compared with the case of representing black using cyan C, magenta M, and yellow Y.

Third Embodiment

Figure 17:
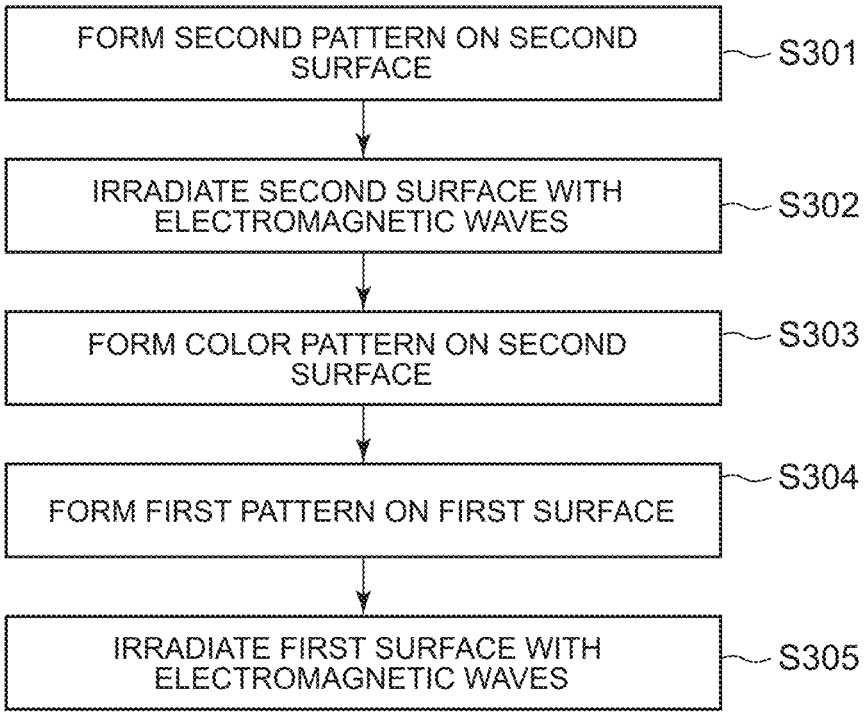
FIG. 17 is a flowchart of a structure manufacturing process according to a third embodiment.

FIG. 17 is a flowchart of a structure forming process according to this embodiment. In this embodiment, too, the ink cartridge 43*k* in the printer 40 stores the ink of black K including carbon black.

The structure manufacturing system 1 first forms the second pattern GP2 on the second surface (surface FS) (step S301). Step S301 is the same as step S101 in FIG. 13.

The structure manufacturing system 1 then irradiates the second surface (surface FS) with electromagnetic waves (step S302). Step S302 is the same as step S104 in FIG. 13.

The structure manufacturing system 1 then forms the color pattern on the second surface (surface FS) (step S303). Here, the user inputs an instruction to form the color pattern to the computer 10. The computer 10 responsively generates the print data and print control data corresponding to the color pattern data, and outputs the generated data to the printer 40. The printer 40 forms the color pattern on the surface FS of the print medium M in the inks of cyan C, magenta M, yellow Y, and black K, based on the print data and print control data.

In step S303, the structure corresponding to the second pattern GP2 is formed on the surface FS. This structure is, however, smaller than the structure formed by the first pattern GP1 described later, and so its maximum height is within a predetermined height. Accordingly, the structure does not obstruct the formation of the color pattern by the printer 40, and a decrease in printing quality hardly occurs.

After forming the color pattern on the second surface, the structure manufacturing system 1 forms the first pattern GP1 on the first surface (surface BS) (step S304), irradiates the first surface (surface BS) with electromagnetic waves (step S305), and ends the structure formation process in FIG. 17. Steps S304 and S305 are the same as steps S103 and S105 in FIG. 13.

According to this structure, too, the difference between the shape of the structure to be manufactured and the shape of the actually manufactured structure can be reduced. Therefore, the structure of the desired shape can be manufactured using the print medium M. Moreover, since black in the color pattern is represented by the ink of black K including carbon black in this embodiment, good coloration can be achieved while saving the ink consumption as compared with the case of representing black using cyan C, magenta M, and yellow Y.

The foregoing embodiments each show a specific example to help understanding the present invention, and the present invention is not limited to these embodiments. Various changes or modifications can be made to the structure manufacturing method, the processed medium manufacturing method, the processed medium, the data generation method, and the program without departing from the scope of the present invention as defined in the claims.

Although FIG. 3 illustrates the inkjet printer, the printer is not limited to an inkjet printer. Any printer such as a laser printer may be used. Although FIG. 4 illustrates the heater in which the light source unit moves relative to the print medium M, this is merely an example of the heater 50, and any heater that irradiates the print medium M uniformly with electromagnetic waves may be used. For example, the heater 50 may have the light source unit 54 fixed to the placement table 51 and further include a conveyance mechanism (not illustrated), where the conveyance mechanism conveys the print medium M so that the print medium M moves relative to the light source unit 54. Alternatively, the heater may include such a light source unit that irradiates the whole print medium M with electromagnetic waves simultaneously.

The procedure described in each of the foregoing embodiments is an example of the structure manufacturing procedure, and the order of steps may be changed. For example, although FIGS. 13, 16, and 17 illustrate an example of forming the first pattern after the second pattern, the second pattern may be formed after the first pattern, or the two patterns may be formed simultaneously. FIGS. 13, 16, and 17 illustrate an example of irradiating the material forming the second pattern GP2 with electromagnetic waves from the second surface side before irradiating the material forming the first pattern GP1 with electromagnetic waves from the first surface side. Regarding this point, it is desirable to perform the steps in the order described in the embodiments, that is, irradiating the first surface with electromagnetic waves after irradiating the second surface with electromagnetic waves. This is because the structure formed by the second pattern GP2 is smaller than the structure formed by the first pattern GP1 and so its shape tends to change with a change in the conditions (e.g. the state of the expansion layer M2, the distance to the light source). Although the above describes an example of forming both the first pattern GP1 and the second pattern GP2, only one of the patterns may be formed. Since the heat transferred to the expansion layer diffuses more and the influence of the adjacent region is greater when the surface on which the pattern is formed is farther from the expansion layer, the aforementioned technique is particularly effective in adjusting the pattern formed on the surface far from the expansion layer.

The material forming the first pattern and the material forming the second pattern may be any material for converting electromagnetic wave energy into heat energy. Accordingly, the first material forming the first pattern and the second material forming the second pattern may be the same material or different materials for converting electromagnetic wave energy into heat energy.

What is claimed is:

1. A processed medium manufacturing method comprising:

forming a pattern on a print medium including an expansion layer that expands by heating, wherein the pattern is configured to convert electromagnetic wave energy into heat energy, wherein the pattern is formed in a first region of a first surface of the print medium and a second region of the first surface of the print medium, wherein the first region corresponds to a first part of the expansion layer that is expanded by heating to a first desired thickness, and the second region corresponds to a second part of the expansion layer that is expanded by heating to a second desired thickness thicker than the first desired thickness, wherein the first region of the first surface and the second region of the first surface of the print medium meet at a boundary, wherein a boundary region of the first surface of the print medium comprises the boundary, an adjacent portion of the first region adjacent to the boundary and an adjacent portion of the second region adjacent to the boundary, and wherein the pattern is:

formed in a portion of the first region excluding the adjacent portion of the first region at a first density corresponding to the first desired thickness;

formed in a portion of the second region excluding the adjacent portion of the second region at a second density, higher than the first density, corresponding to the second desired thickness; and formed in the boundary region at a third density lower than the first density and lower than the second density.

2. The processed medium manufacturing method according to claim 1, wherein the boundary region is centered on the boundary and the adjacent portion of the first region and the adjacent portion of the second region extend away from the boundary by a same distance.

3. The processed medium manufacturing method according to claim 1, wherein the print medium has the first surface and a second surface opposite to the first surface, and wherein the first surface of the print medium is farther from the expansion layer than the second surface of the print medium.

4. The processed medium manufacturing method according to claim 1, wherein the third density of the pattern formed in the boundary region is 10% or less of the second density.

5. A structure manufacturing method comprising:

forming a pattern on a print medium including an expansion layer that expands by heating, wherein the pattern is configured to convert electromagnetic wave energy into heat energy, wherein the pattern is formed in a first region of a first surface of the print medium and a second region of the first surface of the print medium, wherein the first region corresponds to a first part of the expansion layer that is expanded by heating to a first desired thickness, and the second region corresponds to a second part of the expansion layer that is expanded by heating to a second desired thickness thicker than the first desired thickness, wherein the first region of the first surface and the second region of the first surface of the print medium meet at a boundary, wherein a boundary region of the first surface of the print medium comprises the boundary, an adjacent portion of the first region adjacent to the boundary and an adjacent portion of the second region adjacent to the boundary, and wherein the pattern is:

formed in a portion of the first region excluding the adjacent portion of the first region at a first density corresponding to the first desired thickness;

formed in a portion of the second region excluding the adjacent portion of the second region at a second density, higher than the first density, corresponding to the second desired thickness; and formed in the boundary region at a third density lower than the first density and lower than the second density; and irradiating the print medium with electromagnetic waves.

6. The structure manufacturing method according to claim 5, wherein the boundary region is centered on the boundary and the adjacent portion of the first region and the adjacent portion of the second region extend away from the boundary by a same distance.

7. The structure manufacturing method according to claim 5, wherein the print medium has the first surface and a second surface opposite to the first surface, and wherein the first surface of the print medium is farther from the expansion layer than the second surface of the print medium.

8. The structure manufacturing method according to claim 5, wherein the third density of the pattern formed in the boundary region is 10% or less of the second density.

* * * * *